US007981012B1

(12) United States Patent
Krull

(10) Patent No.: US 7,981,012 B1
(45) Date of Patent: Jul. 19, 2011

(54) EXERCISE WEIGHT SELECTION METHODS AND APPARATUS

(76) Inventor: Mark A. Krull, Bend, OR (US)

( * ) Notice: Subject to any disclaimer, the term of this patent is extended or adjusted under 35 U.S.C. 154(b) by 835 days.

(21) Appl. No.: 11/824,271

(22) Filed: Jun. 29, 2007

Related U.S. Application Data

(60) Provisional application No. 60/817,739, filed on Jun. 30, 2006.

(51) Int. Cl.
*A63B 21/00* (2006.01)

(52) U.S. Cl. ..... 482/107; 482/98

(58) Field of Classification Search ..... 482/93, 482/94, 101–103, 104–108
See application file for complete search history.

(56) References Cited

U.S. PATENT DOCUMENTS

| | | | | |
|---|---|---|---|---|
| 5,876,313 | A * | 3/1999 | Krull | 482/98 |
| 7,413,533 | B2 * | 8/2008 | Lin | 482/108 |
| 2004/0162197 | A1 * | 8/2004 | Towley et al. | 482/107 |
| 2005/0192166 | A1 * | 9/2005 | Shifferaw | 482/94 |
| 2006/0135328 | A1 * | 6/2006 | Doudiet | 482/107 |
| 2007/0161474 | A1 * | 7/2007 | Lippitt | 482/106 |

* cited by examiner

*Primary Examiner* — Jerome W Donnelly

(57) ABSTRACT

A weight lifting member is configured to accommodate a plurality of weights. A selector rod is movably mounted on the weight lifting member for rotation about an axis to selective engage and disengage a first subset of the weights, and for movement axially to selectively engage and disengage a second subset of the weights. A latch must be moved in order to release the selector rod for movement relative to the weight lifting member.

20 Claims, 8 Drawing Sheets

EXERCISE WEIGHT SELECTION METHODS AND APPARATUS

CROSS-REFERENCE TO RELATED APPLICATION

Disclosed herein is subject matter from U.S. Provisional Application No. 60/817,739, filed Jun. 30, 2006.

FIELD OF THE INVENTION

The subject invention relates to exercise weight selection methods and apparatus, and is particularly well-suited for use in connection with exercise dumbbells.

BACKGROUND OF THE INVENTION

Exercise dumbbells are well known in the art and prevalent in the exercise equipment industry. Generally speaking, each dumbbell includes a handle and a desired number of weights or plates which are typically secured to opposite ends of the handle. The dumbbell is lifted up subject to gravitational force acting on the mass of the handle and any attached weights.

Some prior art dumbbells are made as fixed weights, and some people seem to prefer fixed weight dumbbells, perhaps because they are simple to use and solid in construction. However, a disadvantage of fixed weight dumbbells is that numerous such dumbbells are required to provide a range of weight resistance.

Other prior art dumbbells include handles and weight plates that the user is able to add to and/or remove from the handles. These variable weight dumbbells provide an economy of scale because only a few weights may be combined in a variety of ways to provide a range of weight resistance. On the other hand, these variable weight dumbbells require time to change between levels of weight resistance (particularly since a change is typically made to each end of two separate handles), and the loose weight plates may present a storage problem, as well.

Still other prior art, adjustable weight dumbbells (and barbells) do not require the user to handle the weight plates during changeovers, and they maintain the weight plates in orderly fashion when not in use. Examples of these more sophisticated, "selectorized" free weight assemblies are disclosed in U.S. Pat. No. 4,284,463 to Shields (discloses a dumbbell assembly having opposite side weights which are maintained in alignment on a base and selectively connected to a handle by means of cam driven pins on the weights); U.S. Pat. No. 4,529,198 to Hettick, Jr. (discloses a barbell assembly having opposite side weights which are maintained in alignment on respective storage members and selectively connected to a handle by means of axially movable springs); U.S. Pat. No. 4,822,034 to Shields (discloses both barbell and dumbbell assemblies having opposite side weights which are maintained in alignment on a shelf and selectively connected to a handle by means of latches on the weights); U.S. Pat. No. 5,769,762 to Towley, III et al. (discloses various weight assemblies having a plurality of interconnected opposite side weights which are stored in nested relationship to one another and selectively connected to a handle by various means); U.S. Pat. No. 5,839,997 to Roth et al. (discloses a dumbbell assembly having opposite side weights which are maintained in alignment on a base and selectively connected to a handle by means of eccentric cams on a rotating selector rod; U.S. Pat. No. 6,033,350 to Krull (discloses dumbbell assemblies and other weight lifting members having opposite end weights that are maintained in alignment on a base and selectively engaged by means of selector rods that move in opposite directions to engage weights at respective ends of the weight lifting member); U.S. Pat. No. 6,322,481 to Krull (discloses a dumbbell assembly having opposite end weights that are maintained in alignment on a base and selectively connected to a handle by means of a selector rod that engages different combinations of the weights as a function of its position relative thereto). U.S. Pat. No. 6,540,650 to Krull (discloses mechanisms for preventing weight adjustments except when the dumbbell or other weight lifting member occupies a rest position relative to an underlying base).

SUMMARY OF THE INVENTION

The present invention provides methods and apparatus for selectively connecting weights to a weight lifting member. On a preferred embodiment, the weight lifting member is an exercise dumbbell having a handle and at least one selector rod that moves relative to the handle to selectively engage and disengage weight plates relative to the handle. In operation, the selector rod is rotated to selectively engage and disengage a first subset of the weight plates, and it is moved axially to selectively engage and disengage a second subset of the weight plates. As a safety precaution, a separately operated latch may be provided on the handle to discourage unintentional movement of the selector rod. Many of the features and advantages of the present invention will become apparent from the detailed description that follows.

BRIEF OF THE DRAWING

With reference to the Figures of the Drawing, wherein like numerals represent like components throughout the several views, FIG. 1 is a perspective view of a dumbbell constructed according to the principles of the present invention;

DETAILED DESCRIPTION OF THE PREFERRED EMBODIMENT

Figure 1:
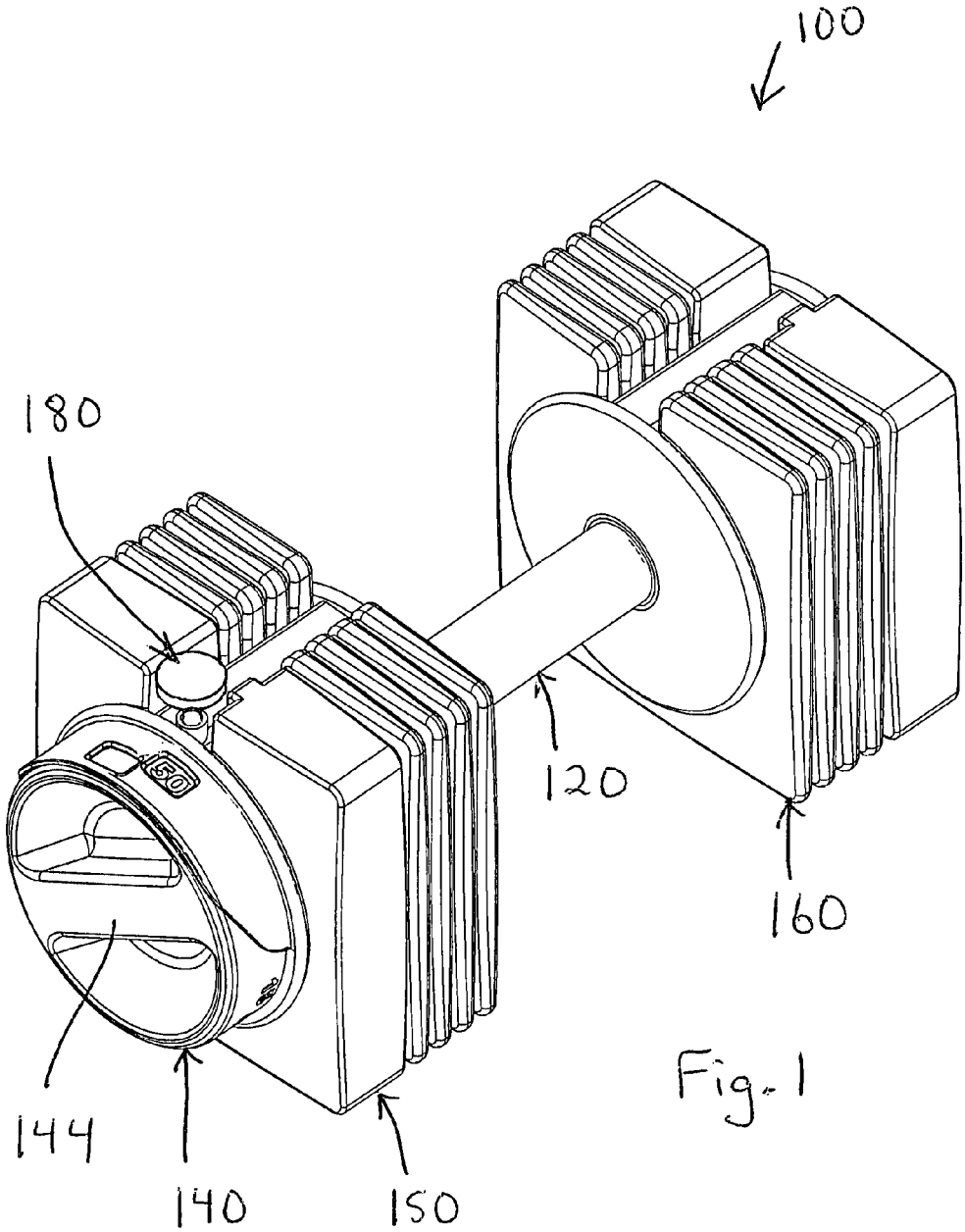

U.S. Pat. No. 4,284,463 to Shields; U.S. Pat. No. 4,529,198 to Hettick, Jr.; U.S. Pat. No. 4,822,034 to Shields; U.S. Pat. No. 5,769,762 to Towley et al.; U.S. Pat. No. 5,839,997 to Roth et al.; U.S. Pat. No. 6,033,350 to Krull; U.S. Pat. No. 6,322,481 to Krull; and/or U.S. Pat. No. 6,540,650 to Krull are incorporated herein by reference because they disclose material which may contribute to understanding of the present invention, including, for example, ways to maintain the weights in axial alignment relative to a weight lifting member and/or a weight supporting base, and ways to latch selector mechanisms in place except when the weight lifting member occupies a rest position relative to the weight supporting base.

A preferred embodiment dumbbell constructed according to the principles of the present invention is designated as 100 in FIGS. 1-6. The dumbbell 100 has a handle 120 that is rigidly secured between opposite end weight holders or weight supports 110. The handle 120 and the weight supports 110 are similar to those disclosed in U.S. Pat. No. 5,839,997 to Roth et al. Generally speaking (and with reference to FIG. 5), at each end of the dumbbell 100, a block 112 is rigidly secured between inner and outer end plates 114, and spacers or ribs 116 project laterally outward from opposite sides of the block 112. A semi-cylindrical channel member 118 is also rigidly secured between the end plates 114, with an open side of the member 118 arranged to face laterally outward (toward the reader in FIG. 5). The handle 120 and the weight supports 110 may be collectively described as a handle assembly, which is preferably configured to weigh five pounds (independent of any weight plates 150 or 160).

A selector rod 130 is movably mounted on the handle assembly and operable to selectively secure the weight plates 150 and 160 relative thereto. On the depicted embodiment, the relatively larger weight plates 150 are configured to weigh twelve and one-half pounds each, and the relatively smaller weight plates 160 are configured to weigh two and one-half pounds each. With reference to the weights at either end of the dumbbell 100, the larger weight plate 150 may be described as a first subset of such weights, and the smaller plates 160 may be described as a second subset of such weights. The smaller weight plates 160 are similar to those disclosed in U.S. Pat. No. 5,839,997 to Roth et al., and they are identified individually as 160A-160H in FIG. 2 for ease of discussion.

Figure 8:
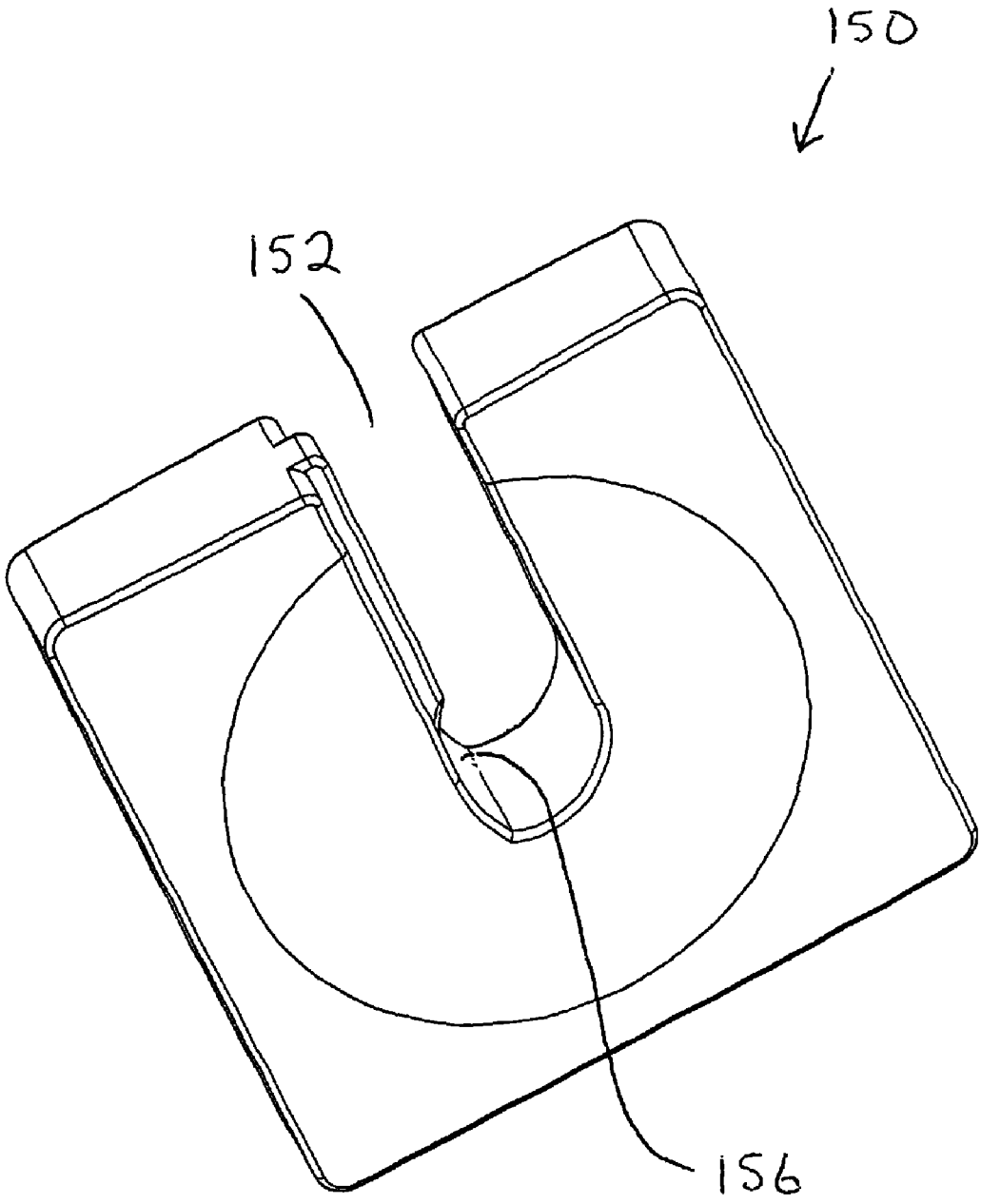
FIG. 8 is a perspective view of one of the larger weight plates on the dumbbell of FIG. 1.

FIG. 8 shows one of the larger weight plates 150 by itself. The weight plate 150 is similar in many respects to the weight plates disclosed in U.S. Pat. No. 5,839,997 to Roth et al. Among other things, it similarly includes an upwardly opening slot 152 configured to receive the channel member 118 and the block 112, and to define an upwardly closed notch 156. In fact, the only significant difference is that the notch 156 extends through only a central portion of the weight plate 150. In other words, thickness has been added to the opposite sides of the weight plate 150 without similarly extending the structure that defines the notch 156. All of the weight plates 150 and 160 are configured to occupy respective axial positions on the handle assembly, as defined by the ribs 116, and they can only move in a downward direction relative thereto (and only when not engaged by the selector rod 130).

Figure 7:
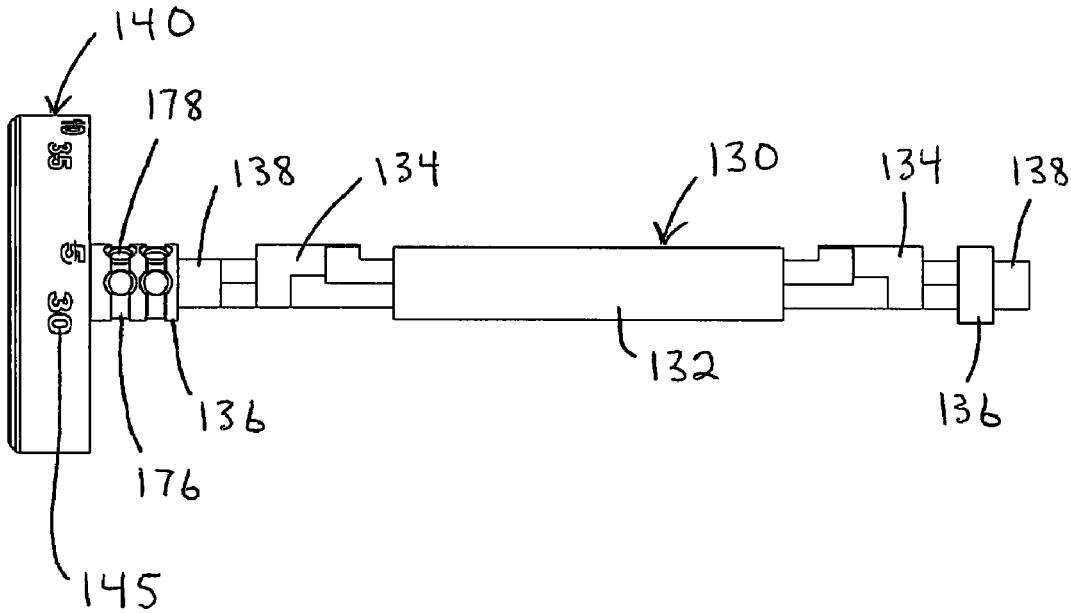
FIG. 7 is a top view of the selector rod and associated knob on the dumbbell of FIG. 1.

The selector rod 130 extends through the handle 120 and both weight supports 110, and a knob 140 is rigidly secured to one end of the selector rod 130. As shown in FIG. 1, the knob 140 includes a nested handle portion 144 that is sized and configured for grasping and turning. FIG. 7 shows the selector rod 130 and the knob 140 apart from the other components of the dumbbell 100. The selector rod 130 is similar in many respects to the one disclosed in U.S. Pat. No. 5,839,997 to Roth et al. In this regard, the selector rod 130 similarly includes a central portion 132 that extends through the handle 120, and flats or recessed surfaces 134 that interrupt the otherwise cylindrical shape of the selector rod 130.

The selector rod 130 has additional features that are neither taught or suggested by U.S. Pat. No. 5,839,997 to Roth et al. More specifically, the selector rod 130 is configured to move along its longitudinal axis to provide greater weight engaging capacity. In this regard, the selector rod 130 is configured to occupy two different axial positions relative to the handle 120. In the first such position, shown in FIGS. 1-3, the knob 140 is relatively closer to the handle 120, and respective "uncut" portions 136 of the selector rod 130 (shown in FIG. 7) occupy the upwardly closed notches 156 in respective larger weight plates 150. As a result, the larger weight plates 150 are constrained to move together with the handle 120, thereby establishing a minimum available weight of thirty pounds and a maximum available weight of fifty pounds (depending on how many of the smaller weight plates 160 are engaged).

Figure 4:
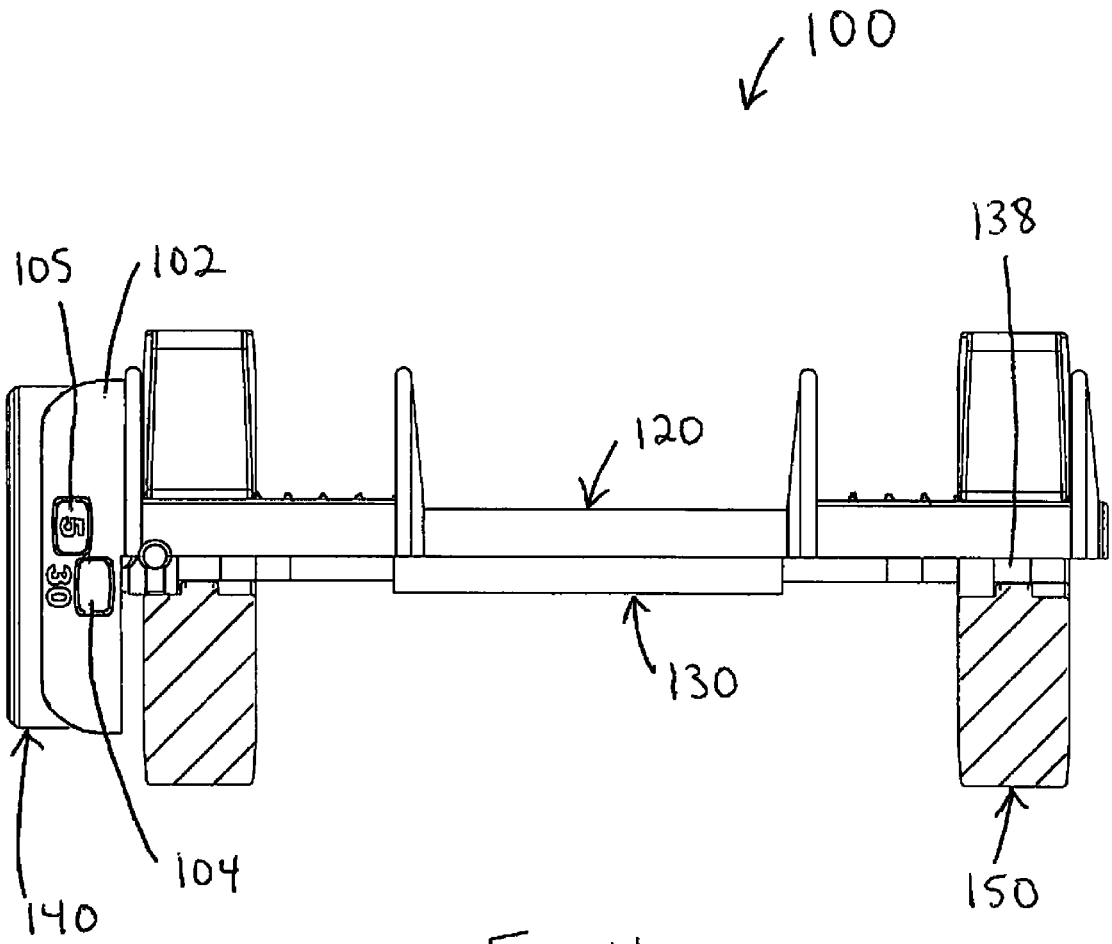
FIG. 4 is a partially sectioned top view of the dumbbell of FIG. 1, with eight relatively smaller weight plates removed, and showing the two relatively larger weight plates disengaged.
Figure 5:
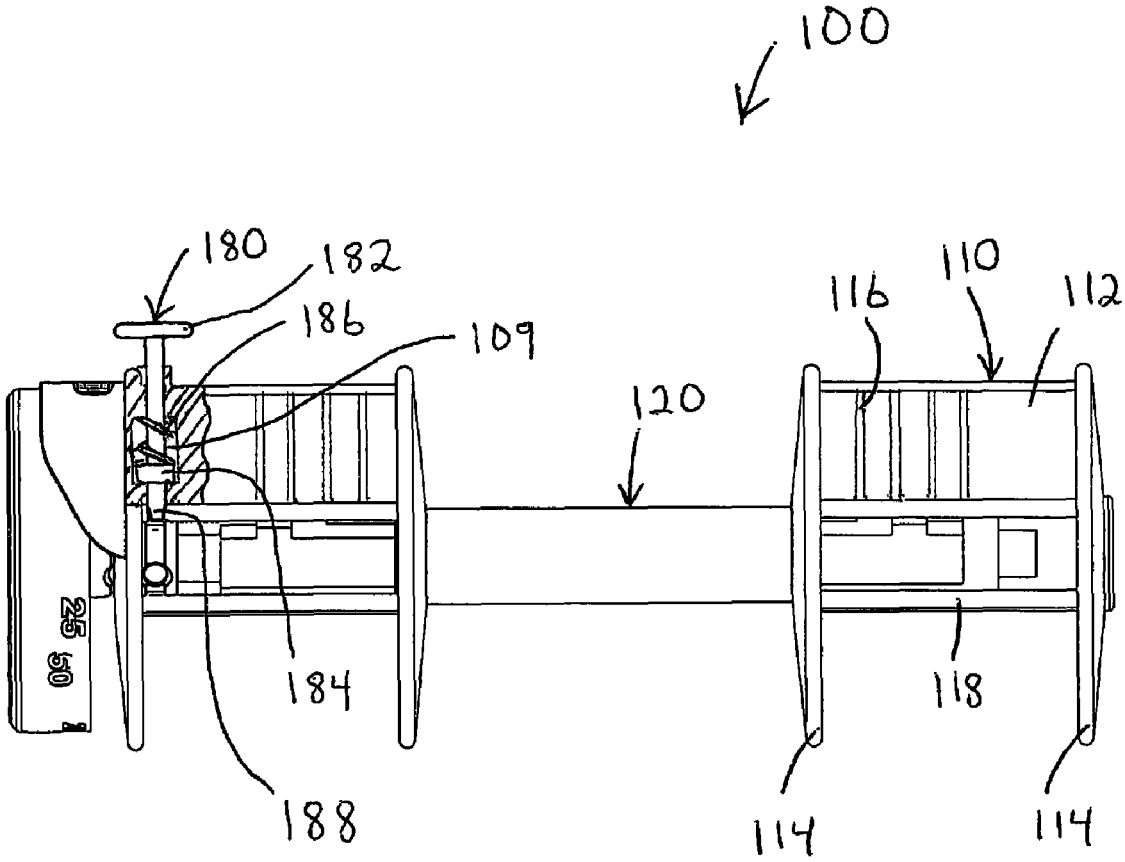
FIG. 5 is a side view of the dumbbell of FIG. 1 with all of the weight plates removed, and the associated selector rod positioned in the same manner as shown in FIG. 4.
Figure 6:
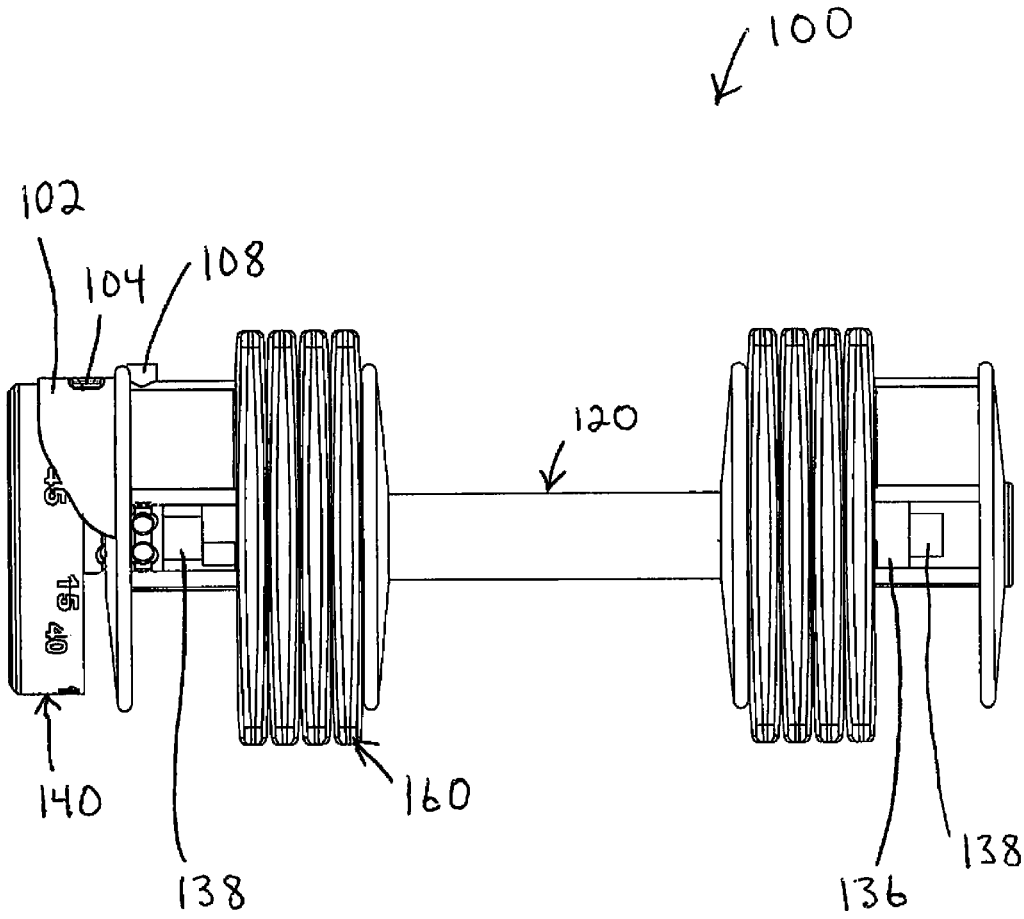
FIG. 6 is a side view of the dumbbell of FIG. 1 with two relatively larger weight plates removed.

When the selector rod 130 is moved to the other position, shown in FIGS. 4-6, the knob 140 is relatively further from the handle 120, and respective "cut" portions 138 of the selector rod occupy the upwardly closed notches 156 in respective larger weight plates 150. As a result, the larger weight plates 150 are released from the handle 120, thereby establishing a minimum available weight of five pounds and a maximum available weight of twenty-five pounds (depending on how many of the smaller weight plates 160 are engaged).

In either axial position, the selector rod 130 is rotatable among five different orientations relative to the handle 120 to selectively engage and disengage the smaller weight plates 160. Each incremental change in orientation causes one smaller weight plate 160 to be engaged or disengaged (depending on the direction of rotation) at each end of the dumbbell 100. When the selector rod 130 occupies the axial position shown in FIGS. 4-6, the smaller weight plates 160 are sequentially engaged in the following order (to increase the "ready-to-lift" weight from five to twenty-five pounds): first 160A and 160G; then 160B and 160F; then 160C and 160E; and finally, 160D and 160H. When the selector rod 130 occupies the axial position shown in FIGS. 1-3, the smaller weight plates 160 are sequentially engaged in the following order (to increase the "ready-to-lift" weight from thirty to fifty pounds in balanced increments of five pounds): first 160B and 160H; then 160C and 160G; then 160D and 160F; and finally, 160A and 160E. This seemingly peculiar engagement order is a by-product of the axially shifting selector rod 130, which causes each of the respective flats 134 to move one weight plate over.

Figure 3:
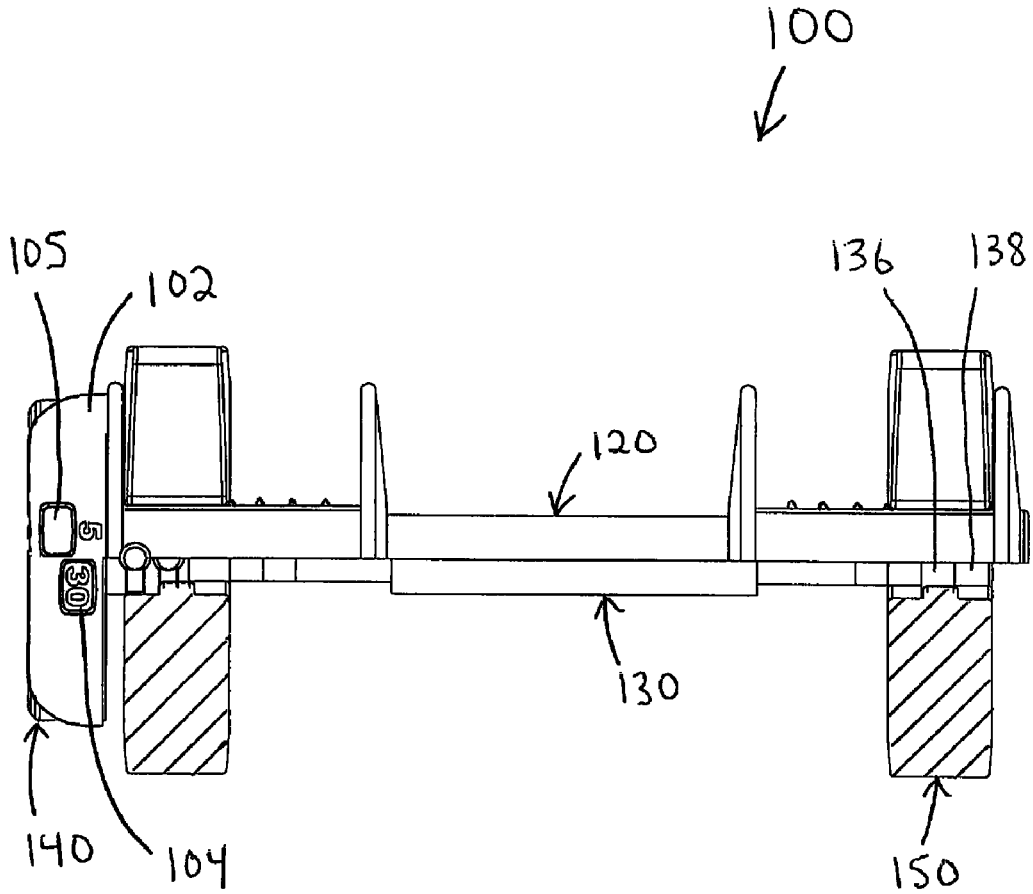
FIG. 3 is a partially sectioned top view of the dumbbell of FIG. 1, with eight relatively smaller weight plates removed, and showing two relatively larger weight plates engaged for lifting.

With reference to FIGS. 3-4, an arcuate flange 102 projects outward from one end of the handle assembly, and two openings or windows 104 and 105 are defined within the flange 102. The windows 104 and 105 are spaced both axially and circumferentially relative to one another. As shown in FIG. 7, two sets of indicia 145 are disposed about the sidewall of the knob 140 at circumferentially spaced locations. One row of indicia 145 includes the numbers "5", "10", "15", "20", and "25", and this row axially aligns with the window 105 when the knob 140 occupies the position shown in FIG. 4. With reference to FIG. 4, the indicia "30" would not be visible on a physical embodiment of the dumbbell 100, but it is shown in FIG. 4 to facilitate understanding of the subject invention. The other row of indicia 145 includes the numbers "30", "35", "40", "45", and "50", and this row axially aligns with the window 104 when the knob 140 occupies the position shown in FIG. 3. With reference to FIG. 3, the indicia "5" would not be visible on a physical embodiment of the dumbbell 100, but it is shown in FIG. 3 to facilitate understanding of the subject invention. In other words, the knob 140 is pushed toward the handle 120 to make the row of larger numbers axially align with the window 104 (and to engage the larger weights 150), and the knob 140 is pulled away from the handle 120 to make the row of smaller numbers axially align with the window 105 (and to release the larger weights 150).

Figure 2:
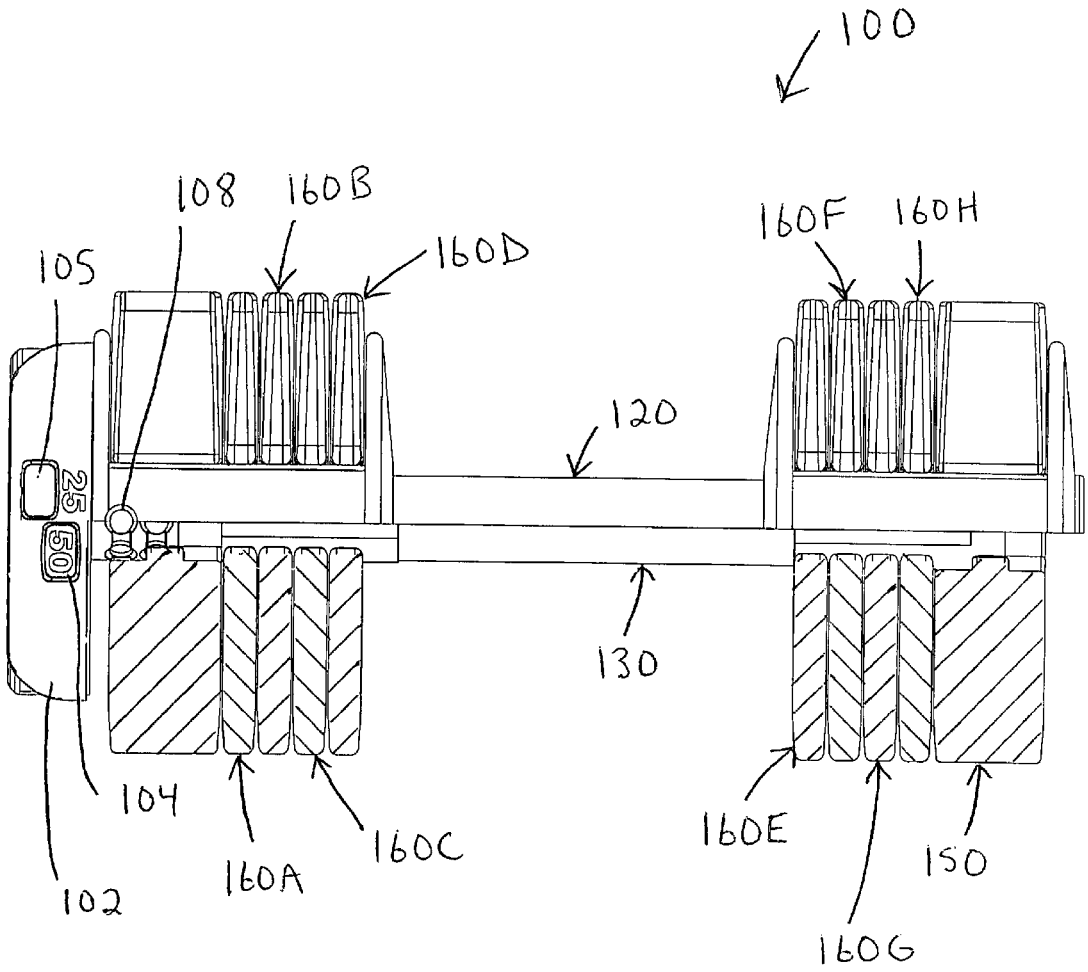
FIG. 2 is a partially sectioned top view of the dumbbell of FIG. 1.

The circumferential spacing of the indicia 145 is such that individual numbers align with a respective window 104 or 105 to indicate the "current" weight of the dumbbell 100 (as a function of how many weight plates 150 and 160 are secured to the handle assembly. For example, FIG. 4 shows "5" in the window 105, and none of the weights 150 or 160 are engaged by the selector rod 130 (because the cut portions 138 align axially with the upwardly closed notches 156 in the weight plates 150, and all of the flats 134 align axially with the upwardly closed notches in the weight plates 160). In contrast, FIG. 3 shows "30" in the window 104, and the weights 150 are now engaged by the selector rod 130 (because the uncut portions 136 align axially with the upwardly closed notches 156 in the weight plates 150). FIG. 2 shows "50" in the window 104 to indicate that all of the weight plates 150 and 160 are secured to the handle assembly. With reference to FIG. 2, the "25" would not be visible on a physical embodiment of the dumbbell 100, but it is shown in FIG. 2 to demonstrate that it would move into the window 105 if the knob 140 were pulled away from the handle 120 to disengage the larger weight plates 150).

The dumbbell 100 is also provided with means for latching the selector rod 130 in place relative to the handle assembly. As shown in FIGS. 1 and 5, a spring-biased pull-pin 180 is movably mounted on the handle assembly. The pin 180 is not shown in FIGS. 2-4 and 6 to better facilitate depiction and labeling of other components. An uppermost portion 182 of the pull-pin is sized and configured for grasping and pulling. A shaft extends downward from the top portion 182 and through a cylindrical collar 108 (see FIGS. 2 and 6) in the handle assembly. A relatively larger diameter disc-shaped member 184 is rigidly connected to an intermediate portion of the shaft, and is slidably contained within a cylindrical cavity 109 defined by the weight support 110. A helical coil spring 186 is compressed between an upper surface on the disc 184 and a upper wall of the cavity 109, thereby biasing the pull-pin 180 downward toward the selector rod 130. A lower distal end 188 of the shaft is preferably tapered for reasons discussed below.

As shown in FIG. 7, a pair of circumferential grooves 176 are defined in the outer surface of the uncut portion 136 proximate the knob end of the selector rod 130, and holes 178 extend radially into the uncut portion 136 at circumferentially spaced locations along respective grooves 176. The holes 178 are configured and arranged to receive the tapered end 188 of the pull-pin shaft, depending on the axial location and orientation of the selector rod 130. Each of the holes 178 cooperates with the pull-pin 180 to latch the selector rod 130 in a particular weight engaging (or disengaging) position, and to place the appropriate weight indicia 145 in alignment with the appropriate window 104 or 105. In order to adjust the "ready-to-lift" weight of the dumbbell 100, a user must first pull upward on the pull-pin 180, and then move the selector rod 130 to align the desired weight amount with the appropriate window 104 or 105 (which may require axial movement and/or rotation of the selector rod 130).

Although described with reference to a preferred embodiment, the subject invention is not specifically limited thereto. For example, an alternative embodiment may be constructed with an alternative latching arrangement. Some possible alternatives may function more to bias the selector rod against movement, as opposed to lock the selector rod against movement. An example of such an arrangement is disclosed in U.S. Pat. No. 5,839,997 to Rosh et al. Other possible alternatives may lock the selector rod against movement without requiring the user to directly unlock the selector rod. An example of such an arrangement is disclosed in U.S. Pat. No. 6,540,650 to Krull. Still other possible alternatives may mix and match features of the foregoing arrangements and/or additional arrangements disclosed in the other patents incorporated herein by reference.

Persons skilled in the art will also recognize that the subject invention may be implemented with various means for supporting the weight plates in respective axial positions relative to one another. With reference to the preferred embodiment dumbbell 100, for example, a weight supporting base or cradle is desired to support the weight plates in the absence of the handle assembly. Several of the patent incorporated herein by reference disclose suitable bases for this purpose. Furthermore, these same references disclose other ways to support the weight plates in respective axial positions relative to one another. For example, some such arrangements are disclosed in U.S. Pat. No. 6,033,350 to Krull. This same reference also discloses how the subject invention may be implemented in other applications, including weight stack machines, for example.

Persons skilled in the art will also recognize that alternative embodiments of the dumbbell 100 may be constructed using different numbers and/or amounts of weights. Also, the selector rod may be divided into two separate rods, one for each end of the dumbbell, in which case, a separate knob is provided and operated for each said rod. This bifurcation of the selector rod allows a user to select unbalanced "half-weights" (by setting one end to "10" and the other end to "15", for example).

The subject invention may also be described in terms of various methods with reference to the preferred embodiment 100 and the alternative embodiments described herein. For example, the subject invention may be described as a method of selecting a variable amount of weight for exercise purposes, comprising the steps of: providing a plurality of weights; providing a weight lifting member with a weight holder configured to accommodate the weights; movably mounting a selector rod on the weight lifting member for rotation about an axis and for movement along the axis; selectively rotating the selector rod to engage and disengage a first subset of the weights; and selectively moving the selector rod axially to engage and disengage a second subset of the weights, wherein the moving step and the rotating step are performed independent of one another.

The subject invention has been described with reference to specific embodiments and particular applications with the understanding that this disclosure will enable persons skilled in the art to recognize additional embodiments and applications without departing from the spirit of the subject invention. Accordingly, the scope of the subject invention should be limited only to the extent of the following claims.

What is claimed is:

1. An exercise apparatus, comprising:

a plurality of weights;

a weight lifting member configured to occupy a ready position relative to the weights; and a selector rod movably mounted on the weight lifting member, wherein (a) the selector rod is configured and arranged for rotation about its axis relative to the weight lifting member, and when the weight lifting member occupies the ready position, the selector rod is rotatable to selectively engage and disengage a first subset of the weights, and orientation of the selector rod relative to the weight lifting member determines how many weights in the first subset are engaged regardless of how the selector rod is positioned axially relative to the weight lifting member, and (b) the selector rod is configured and arranged for movement axially relative to the weight lifting member, and when the weight lifting member occupies the ready position, the selector rod is movable axially to selectively engage and disengage a second subset of the weights, and axially positioning of the selector rod relative to the weight lifting member determines how many weights in the second subset are engaged regardless of how the selector rod is oriented relative to the weight lifting member.

2. The exercise apparatus of claim 1, wherein each of the weights defines an upwardly opening slot configured to receive the weight lifting member, and a downwardly closed notch configured to receive a respective portion of the selector rod, and the notch opens into the slot.

3. The exercise apparatus of claim 2, further comprising a means for latching the selector rod in a desired position relative to the weight lifting member.

4. The exercise apparatus of claim 3, wherein the means includes a pin that is configured an arranged to move radially relative to the selector rod.

5. The exercise apparatus of claim 1, further comprising a pin configured an arranged to move radially into and out of axially overlapping engagement with the selector rod.

6. The exercise apparatus of claim 1, further comprising two windows defined on the weight lifting member, and indicia associated with the selector rod and visible through only one of the two windows as a function of how the selector rod is positioned relative to the weight lifting member.

7. An exercise dumbbell, comprising:

a handle assembly, including a handle that defines a longitudinal axis, and first and second weight holders connected to opposite ends of the handle;

first and second sets of weight plates sized and configured to occupy respective weight holders; and at least one axially extending weight selecting rod rotatably and slidably mounted on the handle assembly for selectively engaging the weight plates, wherein orientation of the weight selecting rod relative to the handle assembly determines how many weight plates in a first subset of the weight plates are engaged regardless of how the weight selecting rod is positioned axially relative to the handle assembly, and axially positioning of the weight selecting rod relative to the handle assembly determines how many weight plates in a second subset of the weight plates are engaged regardless of how the weight selecting rod is oriented relative to the handle assembly.

8. The exercise dumbbell of claim 7, wherein each of the weight plates defines an upwardly opening slot configured to receive a respective one of the weight holders, and a downwardly closed notch configured to receive a respective portion of the weight selecting rod, and the notch opens into the slot.

9. The exercise dumbbell of claim 8, further comprising a latching means for latching the weight selecting rod in a desired position relative to the handle assembly.

10. The exercise dumbbell of claim 9, wherein the latching means includes a pin that is configured an arranged to move radially relative to the weight selecting rod.

11. The exercise dumbbell of claim 7, further comprising a pin configured an arranged to move radially into and out of axially overlapping engagement with the weight selecting rod.

12. The exercise dumbbell of claim 7, further comprising two windows defined on the handle assembly, and indicia associated with the weight selecting rod and visible through only one of the two windows as a function of how the weight selecting rod is positioned relative to the handle assembly.

13. A method of selecting a variable amount of weight for exercise purposes, comprising the steps of:

providing a weight set, including a plurality of weights; a weight lifting member with a weight holder configured to accommodate the weights; and a selector rod movably mounted on the weight lifting member for both rotation about an axis and movement along the axis;

selectively rotating the selector rod to engage and disengage a first subset of the weights; and selectively moving the selector rod axially to engage and disengage a second subset of the weights, wherein the moving step and the rotating step are performed independent of one another.

14. The method of claim 13, wherein the weight set is provided with a latch on the weight lifting member, and further comprising the step of moving the latch in a radial direction and out of contact with the selector rod in order to release the selector rod for movement axially.

15. The method of claim 13, wherein the weight set is provided with a handle on the weight lifting member, and with a respective said weight holder at each end of the handle, and further comprising the step of grasping the handle and lifting the weight lifting member together with any engaged weights.

16. The method of claim 13, wherein the weight lifting member is provided with two windows, and indicia of different weight amounts arranged to appear in only one of the two windows as a function of how the selector rod is positioned relative to the weight lifting member, and further comprising the step of grasping the handle and lifting whatever indicated amount of weight current appears in one of the windows.

17. The method of claim 16, wherein the weight set is provided with a first set of circumferentially spaced holes formed in the selector rod, and with an axially spaced, second set of circumferentially spaced holes formed in the selector rod, and with a latch on the weight lifting member and biased into an adjacent one of the holes to discourage movement of the selector rod relative to the weight lifting member and to align an associated one of the weight amounts with a respective one of the windows, and further comprising the step of forcing the latch from the adjacent one of the holes in order to move the selector rod relative to the weight lifting member.

18. The method of claim 13, wherein the weight set is provided with a first set of circumferentially spaced holes formed in the selector rod, and with an axially spaced, second set of circumferentially spaced holes formed in the selector rod, and with a latch on the weight lifting member and biased into an adjacent one of the holes to discourage movement of the selector rod relative to the weight lifting member, and further comprising the step of forcing the latch from the adjacent one of the holes in order to move the selector rod relative to the weight lifting member.

19. An exercise dumbbell, comprising:

a plurality of weights;

a weight lifting member having a handle, and first and second weight supports disposed at respective, opposite ends of the handle, wherein the weight supports are configured to accommodate respective said weights;

a selector rod movably mounted on the weight lifting member, wherein the selector rod is configured and arranged for movement into and out of engagement with at least some of the weights; and a pin movably mounted on the weight lifting member, wherein the pin is configured and arranged for movement into and out of engagement with the selector rod, wherein the selector rod is movable in a first direction without causing contemporaneous movement of the pin, and the selector rod is movable in a perpendicular, second direction without causing contemporaneous movement of the pin.

20. The exercise apparatus of claim 1, wherein the selector rod is configured and arranged for selective rotation into and out of underlying engagement with the first subset of the weights independent of the second subset of weights, and for selective axial movement into and out of underlying engagement with the second subset of the weights independent of the first subset of weights.

* * * * *